US010971084B2

(12) United States Patent
Bian et al.

(10) Patent No.: US 10,971,084 B2
(45) Date of Patent: Apr. 6, 2021

(54) DISPLAY DEVICE, CONTROL METHOD AND APPARATUS THEREOF

(71) Applicant: Shanghai Tianma AM-OLED Co., Ltd., Shanghai (CN)

(72) Inventors: Qing Bian, Shanghai (CN); Bojia Lv, Shanghai (CN); Xiangzi Kong, Shanghai (CN)

(73) Assignee: Shanghai Tianma AM-OLED Co., Ltd., Shanghai (CN)

( * ) Notice: Subject to any disclaimer, the term of this patent is extended or adjusted under 35 U.S.C. 154(b) by 0 days.

(21) Appl. No.: 16/840,183

(22) Filed: Apr. 3, 2020

(65) Prior Publication Data

US 2020/0234655 A1 Jul. 23, 2020

(30) Foreign Application Priority Data

Nov. 29, 2019 (CN) ..... 201911205715.X

(51) Int. Cl.
*G09G 3/3291* (2016.01)

(52) U.S. Cl.
CPC ... *G09G 3/3291* (2013.01); *G09G 2300/0452* (2013.01); *G09G 2310/027* (2013.01); *G09G 2320/0633* (2013.01); *G09G 2320/0673* (2013.01)

(58) Field of Classification Search
CPC .. G09G 3/2003; G09G 3/3208; G09G 3/3291; G09G 2300/0452; G09G 2310/027; G09G 2320/0242; G09G 2320/0626; G09G 2320/0633; G09G 2320/0666; G09G 2320/0673; G09G 3/3266; G09G 3/3275; G09G 2300/0819; G09G 2300/0842; G09G 2300/0861; G09G 2320/064; G09G 2360/16; G09G 3/3233
See application file for complete search history.

(56) References Cited

U.S. PATENT DOCUMENTS

2009/0122532 A1* 5/2009 Schevardo ..... H05B 45/20 362/231
2018/0137837 A1* 5/2018 Peana ..... G09G 3/3413
2020/0335042 A1* 10/2020 Son ..... G09G 3/3275

FOREIGN PATENT DOCUMENTS

CN 106415377 A 2/2017
CN 110164366 A 8/2019

* cited by examiner

*Primary Examiner* — Nelson M Rosario
(74) *Attorney, Agent, or Firm* — Alston & Bird LLP

(57) ABSTRACT

Disclosed are a display device and a method control of the display. The method includes: selecting an initial duty and a target initial brightness which generate a color shift is less than or equal to a preset color shift value; calculating a corresponding initial grayscale according to the initial duty and the target initial brightness; searching for an initial data voltage corresponding to the initial grayscale according to a gamma curve, where the initial data voltage is associated with the initial duty and the target initial brightness; and performing a brightness adjustment, where the brightness adjustment comprises either a segmented or a mixed pulse width modulation dimming technique and power modulation dimming technique, where the brightness adjustment is performed in a brightness interval from the target initial brightness to maximum brightness.

17 Claims, 6 Drawing Sheets

DISPLAY DEVICE, CONTROL METHOD AND APPARATUS THEREOF

CROSS-REFERENCE TO RELATED APPLICATIONS

This application claims priority to Chinese patent application No. CN201911205715.X filed with the CNIPA on Nov. 29, 2019, the disclosure of which is incorporated herein by reference in its entirety.

TECHNICAL FIELD

The present disclosure relates to a display technology and, in particular, to a display device, and a method and apparatus to control the display device.

BACKGROUND

An organic light-emitting diode is a type of photoelectric component that uses a multilayer organic thin film structure to generate electroluminescent light. It is simple to manufacture, has low-cost, and applies low driving voltage. These main features make the organic light-emitting diodes stand out in an application of flat panel displays. Therefore, in recent years, as an emerging flat panel display device technology, organic light-emitting diode display devices have become very popular domestic and abroad.

At present time, the brightness adjustment of an organic light-emitting diode display device is to apply pulse width modulation dimming at low brightness, this technique can avoid indivisible gamma curve and severe Mura defect at low brightness. In the case of indivisible gamma curve, different grayscale values may correspond to an identical voltage on the gamma curve; thus these grayscale values cannot be distinguished from each other. However, the power width modulation (PWM) dimming at low brightness often causes severe color shift, which leads to a bias toward red color in most cases. In particular, the existing organic light-emitting diode display device tends to display at higher frequency, which causes obvious color shift phenomenon at low brightness.

SUMMARY

Embodiments of the present disclosure provide a display device and a method and apparatus to control the display device, so as to address color shift at low brightness.

An embodiment of the present disclosure provides a method to control a display device, and the method includes the following steps.

A preset color shift value is provided.

An initial duty and a target initial brightness are selected, which generate a color shift less than or equal to the preset color shift value.

A corresponding initial grayscale is calculated according to the initial duty and the target initial brightness.

An initial data voltage corresponding to the initial grayscale is searched for according to a gamma curve, where the initial data voltage is associated with the initial duty and the target initial brightness.

A brightness adjustment is performed, where the brightness adjustment includes either a segmented or a mixed pulse width modulation dimming technique and power modulation dimming technique, the brightness adjustment is performed in a brightness interval from the target initial brightness to maximum brightness.

An embodiment of the present disclosure further provides an apparatus to control a display device, and the apparatus includes a parameter setting module, a grayscale calculation module and a brightness adjustment module.

The parameter setting module is configured to select an initial duty and a target initial brightness which generate a color shift is less than or equal to a preset color shift value.

The grayscale calculation module is configured to calculate a corresponding initial grayscale according to the initial duty and the target initial brightness, search for an initial data voltage corresponding to the initial grayscale according to a gamma curve, where the initial data voltage is associated with the initial duty and the target initial brightness.

The brightness adjustment module is configured to, in a brightness interval from the target initial brightness and maximum brightness, perform a segmented brightness, where the brightness adjustment includes either a segmented or a mixed pulse width modulation dimming technique and power modulation dimming technique, the brightness adjustment is performed in a brightness interval from the target initial brightness and maximum brightness.

An embodiment of the present disclosure provides a display device including the apparatus as described above.

In the embodiment of the present disclosure, the preset color shift value is provided, the initial duty and the target initial brightness which generate a color shift less than or equal to the preset color shift value is selected, the duty adjustment interval is from the initial duty to the maximum duty, and the brightness adjustment interval is the target initial brightness to the maximum brightness. Obviously, the minimum duty of the display device is the initial duty, and the minimum brightness is the target initial brightness. Under the initial duty and target initial brightness, the color shift of the display device is less than or equal to the preset color shift value, and the severe color shift at low brightness when adjusting the brightness of the display device is alleviated. In addition, in the embodiment of the present disclosure, in the brightness interval from the target initial brightness to the maximum brightness, the pulse width modulation dimming technique and the power modulation dimming technique are used to perform segmented brightness adjustment, or the pulse width modulation dimming technique and the power modulation dimming technique are used for mixed brightness adjustment. The brightness adjustment methods are simple and applicable to all display devices including high frequency display devices. The duty and brightness of an adjusted point are greater than or equal to the initial duty and the target initial brightness. Therefore, the color shift of the adjusted point is less than or equal to the preset color shift value, the severe color shift at low brightness when adjusting the brightness of the display device is effectively alleviated.

DETAILED DESCRIPTION

Apparently, the embodiments described below are part, not all, of embodiments of the present disclosure. Based on the embodiments described herein, all other embodiments acquired by those of ordinary skill in the art without creative work are within the scope of the present disclosure.

Figure 1:
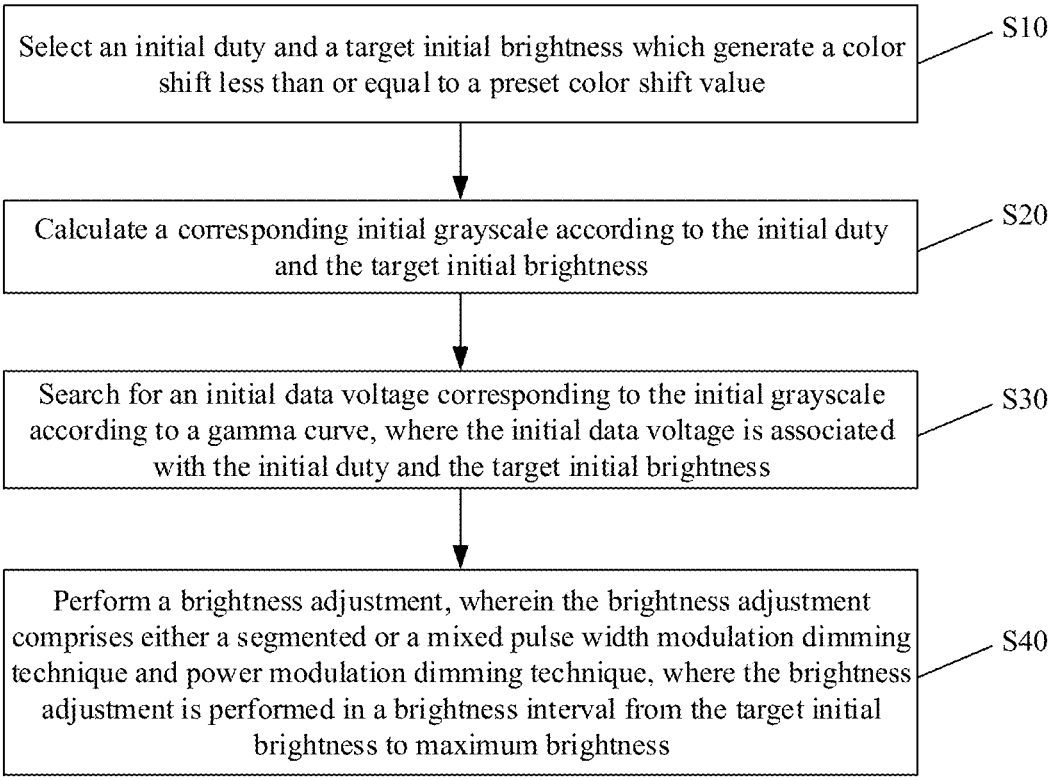
FIG. 1 is a flow chart of a method to control a display device according to an embodiment of the present disclosure.

FIG. 1 is a flow chart of a method to control a display device according to an embodiment of the present disclosure. The method to control a display device provided in the embodiment includes the following steps.

In S10, an initial duty and a target initial brightness are selected which generate a color shift less than or equal to a preset color shift value.

In an embodiment, a preset color shift value is provided before the step of selecting the initial duty and the target initial brightness. In the embodiment, the initial duty of the display device is determined by measuring the display device. The specific process is to control the display of the display device, by analyzing the current and the equivalent capacitance of a RGB sub-pixel driving tube of the display device, finding the minimum duty cycle in which the display device does not exhibit color shift, defining the minimum duty as the initial duty, or selecting a duty that is greater than the minimum duty whose difference from the minimum duty is less than or equal to a preset duty value, and defining the selected duty as the initial duty. For example, it is measured that the minimum duty at which the display device does not exhibit color shift is 4%, and the preset duty value is 2%, so the range of the initial duty is selected to be 4% to 6%. It may be understood that when the display device is tested, a minimum duty with a color shift equal to 0 may not be acquired. Then, the preset color shift value is a color shift value that will hardly affect the display. Based on this situation, the minimum duty where the color shift is less than or equal to the preset color shift value is searched for.

The initial duty is the set minimum value of the duty of the display device. The minimum value of the duty is not equal to 0. The initial duty of different display devices may be different. The target initial brightness is set minimum brightness of the display device. Different manufacturers may reasonably set the target initial brightness corresponding to product initial duties according to product requirements. For example, the initial duty of a display device A is 5%, and the target initial brightness may be selected as Snit or other; or, the initial duty of a display device B is 5%, and the target initial brightness may be selected as Snit or other; or, the initial duty of a display device C is 4%, and the target initial brightness may be selected as Snit or other.

In S20, a corresponding initial grayscale is calculated according to the initial duty and the target initial brightness.

When the duty DA is fixed, the relationship between grayscale and brightness follows a formula $(GrayA/255)^k=LA/LA255$, where LA255 is brightness value corresponding to the duty DA at grayscale 255.

When the grayscale 255 is fixed, the relationship between the duty and the brightness follows a formula LA255/Lmax=DA/Dmax, where the display device is at grayscale 255 and the brightness is the maximum brightness Lmax when the duty is the maximum duty Dmax, and then LA255=Lmax*DA/Dmax may be calculated.

Based on this, the relationship between grayscale and brightness is transformed into a formula $(GrayA/255)^k=LA/(Lmax*DA/Dmax)$ (1). In an embodiment, the initial grayscale corresponding to the initial duty and the target initial brightness is calculated according to a formula (1).

$$(\mathrm{Gray}A/255)^k=LA/(\mathrm{Lmax}*DA/\mathrm{Dmax}) \quad (1).$$

GrayA is a grayscale corresponding to a duty DA and brightness LA, k is a gamma value of the gamma curve, Lmax is the maximum brightness of the display device, and Dmax is a duty corresponding to the maximum brightness Lmax.

In the embodiment, if the initial duty Dc is known, then DA=Dc; if the duty of the display device is the initial duty Dc, and brightness of the display device is the target initial brightness Lc, then LA=Lc; and if the display device is at grayscale 255, the duty of the display device is the maximum duty Dmax, then brightness of the display device is the maximum brightness Lmax. Then, according to the formula (1), a value of the unknown GrayA may be calculated, and the value is the initial grayscale of the display device under the condition of the initial duty is Dc and the target initial brightness is Lc.

It may be understood that the above maximum grayscale 255 limits the maximum grayscale when the grayscale of the display device is 8 Bit. In other embodiments, the above mentioned maximum grayscale may limit the maximum grayscale 4095 when the grayscale of the display device is 12 Bit, which is not limited thereto.

It may be understood that k is a gamma value of the gamma curve. If the gamma curve selected by the display device is different, the gamma value is also different. Generally, a 2.2 gamma curve may be selected, and then the gamma value k is 2.2, but which is not limited thereto.

In S30, an initial data voltage corresponding to the initial grayscale is searched for according to a gamma curve, where the initial data voltage is associated with the initial duty and the target initial brightness.

The gamma curve reflects the correspondence relationship between the grayscale and the data voltage. If the grayscale value is known, the data voltage value corresponding to the grayscale value by querying the gamma curve is acquired. Or, if the data voltage is known, the grayscale value corresponding to the data voltage by querying the gamma curve is acquired.

In the embodiment, the gamma curve is determined, the initial grayscale corresponding to the initial duty and the target initial brightness is also known, and then the data voltage corresponding to the initial grayscale may be acquired by querying the gamma curve. This data voltage may be the initial data voltage corresponding to the initial duty and the target initial brightness.

In S40, a brightness adjustment is performed, where the brightness adjustment includes either a segmented or a mixed pulse width modulation dimming technique and power modulation dimming technique, where the brightness adjustment is performed in a brightness interval from the target initial brightness to maximum brightness.

In the embodiment, the maximum duty of the display device, the maximum brightness corresponding to the maximum duty, the grayscale and the data voltage corresponding to the maximum duty and the maximum brightness value are known, the initial duty of the display device, the target initial brightness and the initial data voltage corresponding to the initial duty are also selected, then the brightness interval from the target initial brightness to the maximum brightness is an adjustable interval of the brightness of the display device, and the duty interval from the initial duty to the maximum duty is an adjustable interval of the duty of the display device.

In a brightness interval from the target initial brightness to the maximum brightness, a segmented brightness adjustment is performed by using a pulse width modulation dimming technique and a power modulation dimming technique. The brightness interval from the target initial brightness to the maximum brightness may be divided into multiple brightness sub-intervals. In the first brightness sub-interval a brightness adjustment may be performed by the pulse width modulation dimming technique, that is, the data voltage is maintained, and the duty is adjusted to achieve the required target brightness. In the second brightness sub-interval a brightness adjustment may be performed by the power modulation dimming technique, that is, the duty is maintained, and the data voltage is adjusted to achieve the required target brightness, and so on. Preferably, the brightness interval from the target initial brightness to the maximum brightness may be divided into an even number of brightness sub-intervals. Then, in the first brightness sub-interval a brightness adjustment may be performed by the pulse width modulation dimming technique, and in the last brightness sub-interval a brightness adjustment may be performed by the power modulation dimming technique. It may be understood that at least one brightness value is selected as a node in a brightness interval from the target initial brightness to the maximum brightness for use in dividing into multiple brightness sub-intervals.

In another embodiment, in a brightness interval from the target initial brightness to the maximum brightness, a mixed brightness adjustment is performed by using the pulse width modulation dimming technique and the power modulation dimming technique. In a brightness interval from the target initial brightness to the maximum brightness, the required target brightness is achieved by adjusting the data voltage and the duty simultaneously Here, the brightness adjustment method is referred to as 51 adjustment, the pulse width modulation dimming technique is PWM dimming, and the power modulation dimming technique is DC dimming. Obviously, the 51 adjustment method in the embodiment is segmented dimming by using the DC dimming and the PWM dimming, or mixed dimming by using PWM+DC. It may be understood that the duty when 51=0 is set as the initial duty, the initial duty is not 0 and the color shift is less than or equal to the preset color shift value. Since the initial duty when 51=0 is greater than 0, the duty of all 51 nodes during the brightness adjustment is greater than or equal to the initial duty (duty≥a %), and no color shift occurs. A 51 curve may be selected as linear or 2.2 curve or other according to customer needs.

Here, the brightness adjustment method is suitable for a display device with an arbitrary pulse and an arbitrary duty, and also for a display device with a 100% duty display. The related designers in the embodiment may select different initial duties according to actual light-emitting situations of products.

In the embodiment of the present disclosure, by selecting the initial duty and the target initial brightness which generate the color shift less than or equal to the preset color shift value, the duty adjustment interval is from the initial duty to the maximum duty, and the brightness adjustment interval is the target initial brightness to the maximum brightness. Obviously, the minimum duty of the display device is the initial duty, and the minimum brightness is the target initial brightness. Under the initial duty and target initial brightness, the color shift of the display device is less than or equal to the preset color shift value, and the severe color shift at low brightness when adjusting the brightness of the display device is alleviated. In addition, in the embodiment of the present disclosure, in the brightness interval from the target initial brightness to the maximum brightness, the pulse width modulation dimming technique and the power modulation dimming technique are used to perform segmented brightness adjustment, or the pulse width modulation dimming technique and the power modulation dimming technique are used for mixed brightness adjustment. The brightness adjustment methods are simple and applicable to all display devices including high frequency display devices. The duty and brightness of an adjusted point are greater than or equal to the initial duty and the target initial brightness. Therefore, the color shift of the adjusted point is less than or equal to the preset color shift value, the severe color shift at low brightness when adjusting the brightness of the display device is effectively alleviated.

Exemplarily, the display device includes a red sub-pixel R, a green sub-pixel G, and a blue sub-pixel B.

Figure 2:
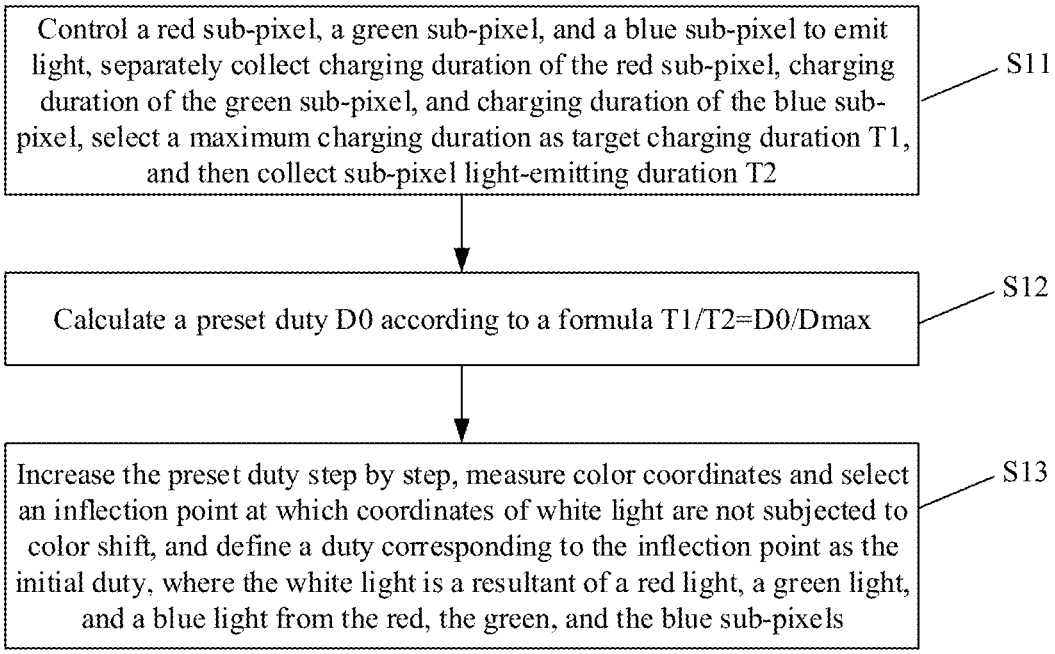
FIG. 2 is a flow chat of the step S10 shown in FIG. 1.

As shown in FIG. 2, the step of selecting an initial duty and target initial brightness which generate a color shift less than or equal to a preset color shift value in S10 includes the following steps.

In S11, the red sub-pixel, the green sub-pixel, and the blue sub-pixel are controlled to emit light, charging duration of the red sub-pixel, charging duration of the green sub-pixel, and charging duration of the blue sub-pixel are separately collected, maximum charging duration is defined as target charging duration T1, and then sub-pixel light-emitting duration T2 is collected.

In S12, a preset duty D0 is calculated according to a formula T1/T2=D0/Dmax.

In S13, the preset duty is increased step by step, color coordinates is measured and an inflection point at which coordinates of white light are not subjected to color shift is selected, and a duty corresponding to the inflection point is defined as the initial duty, where the white light is a resultant of a red light, a green light, and a blue light from the red, the green, and the blue sub-pixels.

Figure 3:
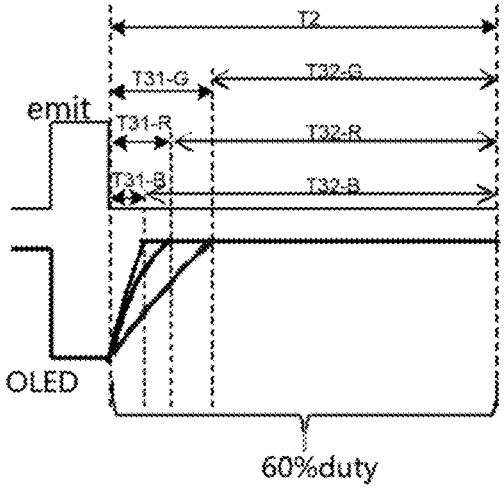
FIG. 3 is a charging diagram of the RGB three-color sub-pixels in the display device.

Referring to FIG. 3, the duty of a light-emitting stage of the display device is 60%. The light-emitting stage includes a pulse rising edge period T31 and a pulse stabilization period T32. The pulse rising edge period T31 is the charging and light-emitting duration of the sub-pixel. In the pulse rising phase T31, the light-emitting current is unstable, and color shift phenomenon of the sub-pixel is obvious. The pulse stabilization phase T32 is the stable light-emitting duration of the sub-pixel. In the pulse stabilization period T32, the light-emitting current is stable, and the color shift phenomenon of the sub-pixel is significantly improved. The pixels include RGB three-color sub-pixels. When the RGB three-color sub-pixels all enter the pulse stabilization phase, the pixels emit light steadily and the color shift is significantly improved. When at least one of the RGB three-color sub-pixels is in the pulse rising edge phase, stable light-emitting current causes obvious color shift of pixels. Therefore, a duty of a junction between the maximum pulse rising edge phase T31 and the corresponding pulse stabilization phase T32 in the pixel is selected to be approximately equal to the initial duty.

In the display device, the corresponding drive tube currents and equivalent capacitances of R, G, and B are different, so the R sub-pixel, G sub-pixel, and B sub-pixel have different charging duration T31 when emitting light. As shown in FIG. 3, the duty of the light-emitting stage of the display device is 60%, the RGB three-color sub-pixels emit light, and then the light-emitting duration T2 of the RGB three-color sub-pixels is T31+T32, that is, the light-emitting duration of the RGB three-color sub-pixel T2 is consistent, and T2 can be calculated by measurement. The RGB sub-pixels are controlled to emit light. Charging duration T31-R of R sub-pixel, charging duration T31-G of G sub-pixel, and the charging duration T31-B of B sub-pixel may be collected through measurement, where the charging duration T31-G of the G sub-pixel is the longest, and then the charging duration T31-G of the G sub-pixel is defined as the target charging duration T1.

T1 and T2 may be acquired through measurement. It is also known that the duty Dmax corresponding to the light-emitting duration T2 of the RGB three-color sub-pixels is 60%. According to a formula T1/T2=D0/Dmax, the duty D0 corresponding to the charging duration T1 may be calculated. The preset duty D0 is a duty of a junction between the maximum pulse rising edge phase T31 and the pulse stabilization phase T32 in the pixel. At this time, the color shift is not obvious.

Figure 4:
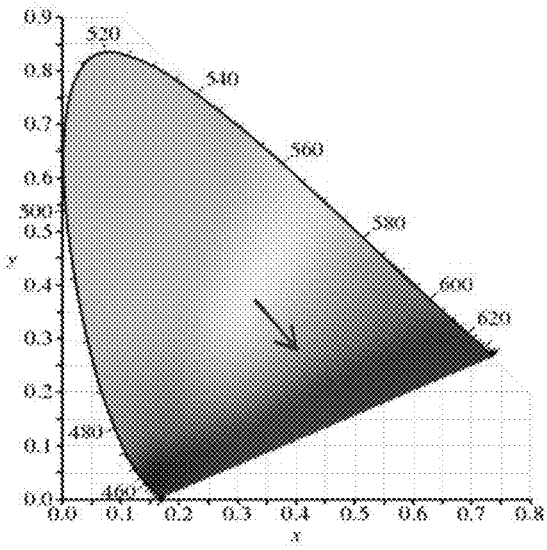
FIG. 4 is a standard color coordinates.

In order to further reduce the color shift, the preset duty may be increased step by step, such as increasing the preset duty step by step using 1% as a step value. Referring to the color coordinates shown in FIG. 4, the color coordinates are measured and an inflection point at which the white color coordinates are not subjected to the color shift is selected, and a duty corresponding to the inflection point is defined as the initial duty. In this way, the display device adjusts between the initial duty and the maximum duty, and the obvious color shift at the rising edge of the pulse is avoided.

The operation of selecting the initial duty and target initial brightness which generate the color shift less than or equal to the preset color shift value in S10 may also be implemented by the following steps, and the steps include: reducing from a duty corresponding to the maximum brightness step by step to a first duty according to a first step value, and measuring color coordinates and determining whether white color coordinates are subjected to color shift; and if the color shift does not occur, reducing from the first duty step by step according to a second step value, measuring the color coordinates and selecting an inflection point at which the white color coordinates are not subjected to the color shift, and defining a duty corresponding to the inflection point as the initial duty; where the first step value is greater than the second step value.

It is known that the sub-pixels of the display device are not subjected to the color shift during the light-emitting stabilization stage. Then, reduction is performed from the duty corresponding to the maximum brightness step by step to the first duty according to the first step value, and color coordinates are measured every step to determine whether the white color coordinates are subjected to the color shift. The first step value may be set to a larger value, for example, the maximum duty is 60%, the first step value is 5%, and the first duty is 20%.

If the color shift does not occur until the display device stepped to the first duty, then reduction is performed from the first duty according to the second step value, and the color coordinates are measured once every step to determine whether the white color coordinates are subjected to the color shift, where the first step value is greater than the second step value. For example, the second step value is 2%.

An inflection point at which the white color coordinates are not subjected to the color shift is selected, and a duty corresponding to the inflection point is defined as the initial duty. If the white color coordinates are not subjected to the color shift when the duty is 10%, the white coordinate are subjected to the color shift when the duty is 8%, and then the duty is adjusted to 9% to determine whether the white color coordinates are subjected to the color shift. If the color shift occurs, then 10% is defined as the inflection point at which no color shift occurs, and the duty 10% corresponding to the inflection point is defined as the initial duty.

It may be understood that the no color shift occurs described herein may also be that the color shift is in a very small range, and it may be regarded as no color shift occurs in the display device.

In the embodiment, the duty without color shift is selected and is set to the lowest duty when the brightness is adjusted, that is, the initial duty, so as to limit the minimum value of the product duty to avoid the color shift. Both the initial duty and the target initial brightness are not 0, which improves the low brightness and color shift at a high frequency during brightness adjustment and optimizes the image display effect of the display device.

Figure 5:
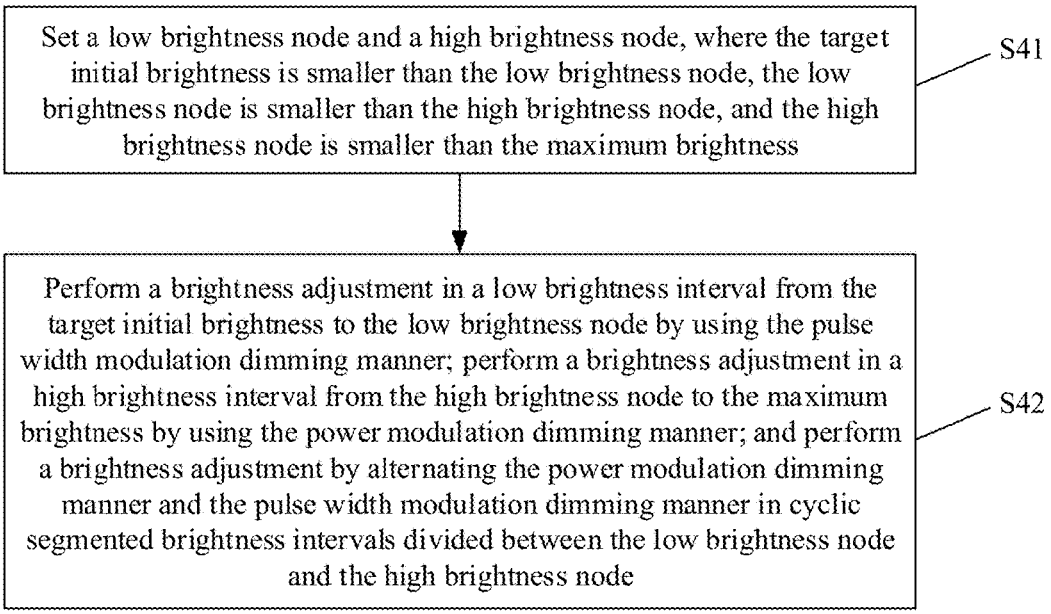
FIG. 5 is the flow chart of the method in step S40 shown in FIG. 1.

Exemplarily, the operation of performing segmented brightness adjustment using the pulse width modulation dimming technique and the power modulation dimming technique of S40 as shown in FIG. 5 includes the following steps.

In S41, a low brightness node and a high brightness node are set, where the target initial brightness is smaller than the low brightness node, the low brightness node is smaller than the high brightness node, and the high brightness node is smaller than the maximum brightness.

In S42, the pulse width modulation dimming technique is used to perform the brightness adjustment in a low brightness interval from the target initial brightness to the low brightness node; the power modulation dimming technique is used to perform the brightness adjustment in a high brightness interval from the high brightness node to the maximum brightness; and the brightness adjustment is performed by alternating the power modulation dimming technique and the pulse width modulation dimming technique in cyclic segmented brightness intervals divided between the low brightness node and the high brightness node.

In the embodiment, the target initial brightness and the maximum brightness and the brightness interval from the target initial brightness to the maximum brightness are known, two different brightness values A and B are selected in the brightness interval, the target initial brightness is less than the brightness value A, and the brightness value A is less than the brightness value B, the brightness value B is less than the maximum brightness, the lower brightness value A is used as the low brightness node, and the higher brightness value B is used as the high brightness node. It may be understood that relevant practitioners may reasonably set the low brightness node and the high brightness node according to the needs of the product. In S42, the pulse width modulation dimming technique is used to perform a brightness adjustment in a low brightness interval from the target initial brightness to the low brightness node; the power modulation dimming technique is used to perform a brightness adjustment in a high brightness interval from the high brightness node to the maximum brightness; and a brightness adjustment is performed by alternating the power modulation dimming technique and the pulse width modulation dimming technique in cyclic segmented brightness intervals divided between the low brightness node and the high brightness node. Different dimming techniques for two adjacent brightness intervals may be selected.

Figure 6:
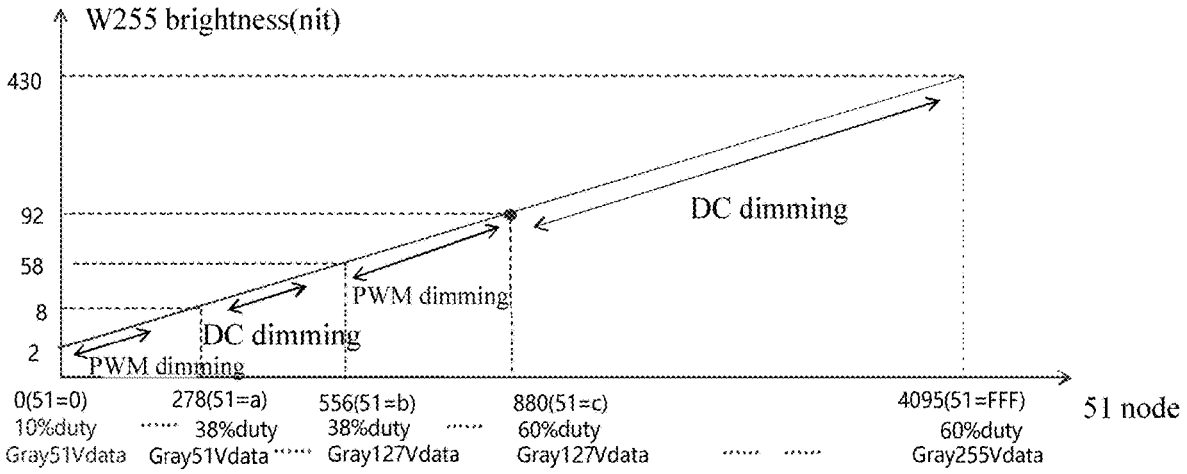
FIG. 6 shows the relationship between the brightness interval and the dimming amount of the display device according to an embodiment of the present disclosure.

Referring to FIG. 6, the initial duty is 10%, the maximum duty is 60%, the target initial brightness is 2 nit, the maximum brightness is 430 nit, the low brightness node is selected as 7 nit, and the high brightness node is 92 nit. The brightness adjustment is performed by using PWM dimming technique in the low brightness interval of 2 nit to 7 nit; and the brightness adjustment is performed by using DC dimming technique in the high brightness interval of 92 nit to 430 nit. It is also possible to select at least one brightness value C between the low brightness node and the high brightness node. The brightness value C is 58 nit, and the brightness adjustment is performed by using DC dimming technique in the brightness interval of 7 nit to 58 nit, and the brightness adjustment is performed by using the PWM dimming technique in the brightness interval of 58 nit to 92 nit.

In the PWM dimming technique, the data voltage is not changed, and the brightness of the display device is changed by adjusting the duty. Then when in the brightness interval the brightness adjustment is a PWM dimming technique, the data voltage of the brightness interval remains the same as the data voltage of the starting brightness node of the brightness interval, so the data voltage of the starting brightness node of the brightness interval needs to be selected in advance.

In the DC dimming technique, the duty is not changed, and the brightness of the display device is changed by adjusting the data voltage. Then when in the brightness interval the brightness adjustment is a DC dimming technique, the duty of the brightness interval remains the same as the duty of the ending brightness node of the brightness interval, so the duty of the ending brightness node of the brightness interval needs to be selected in advance.

The brightness adjustment by using pulse width modulation dimming in the brightness interval includes: acquiring a first data voltage corresponding to a starting brightness node Lq of the brightness interval, and acquiring a second data voltage corresponding to an ending brightness node Lz of the brightness interval, where the second data voltage is equal to the first data voltage; and selecting a duty Dz corresponding to the ending brightness node according to a formula Dq/Dz=Lq/Lz, where Dq is a duty corresponding to the starting brightness node.

Referring to FIG. 6, the target initial brightness is 2 nit and the initial duty is 10%. According to steps S10 to S40, the initial data voltage Gray51Vdata corresponding to the target initial brightness may be calculated. In the low brightness interval of 2 nit to 7 nit, the brightness adjustment is performed by using the PWM dimming technique. Then the data voltage maintained in the brightness interval is the initial data voltage Gray51Vdata, and the data voltage corresponding to the ending brightness node 7 nit in the brightness interval is the initial data voltage Gray51Vdata. If the data voltage is fixed, the grayscale will not change. Then the relationship between brightness and duty will satisfy the duty and brightness formula Dq/Dz=Lq/Lz, where Dq is the initial duty, Lq is the target initial brightness, and Lz is the interval ending brightness node 7 nit, and then it can be calculated that Dz is about 38%. It is known that in the low brightness interval 2 nit to 7 nit where the brightness adjustment is performed by using the PWM dimming technique, the brightness of the display device varies between 10% to 38%.

In an embodiment, the step of performing the brightness adjustment in a brightness interval by using the power modulation dimming technique includes: acquiring a duty corresponding to an ending brightness node Lz of the brightness interval, and defining the duty as a duty corresponding to a starting brightness node Lq of the brightness interval; calculating a grayscale corresponding to the starting brightness node and the duty of the starting brightness node; and searching for a data voltage corresponding to the grayscale according to the gamma curve, and defining the data voltage as a data voltage corresponding to the starting brightness node Lq.

Referring to FIG. 6, the maximum brightness is 430 nit, the maximum duty is 60%, and the data voltage corresponding to the maximum brightness 430 nit is Gray255Vdata. In the high brightness interval of 92 nit to 430 nit, the brightness adjustment is performed by using DC dimming technique, and then the duty in the brightness interval is maintained to be the maximum duty 60%. The relationship between the grayscale and the brightness satisfies formula (1), the starting brightness node LA is 92 nit, the ending brightness node Lmax is 430 nit, the duty DA of the starting brightness node and the duty Dmax of the ending brightness node are both 60%, the grayscale of the initial brightness node 92 nit may be calculated as Gray127, data voltage corresponding to the grayscale Gray127 is searched for according to the gamma curve, and the data voltage is the data voltage Gray127V corresponding to the starting brightness node 92 nit. It is known that in the high brightness interval 92 nit to 430 nit where the brightness adjustment is performed by using the DC dimming technique, the brightness of the display device varies between the data voltages Gray127Vdata to Gray255Vdata.

By analogy, in a brightness interval of 7 nit to 58 nit where the brightness adjustment is performed by using the DC dimming technique, according to the duty 38% and the data voltage Gray51Vdata corresponding to 7 nit, and a known brightness node 58 nit, the duty 38% corresponding to 58 nit is acquired, and the data voltage Gray127Vdata is calculated. Then the relevant parameters of the starting node and the end node of the brightness interval of 58 nit to 92 nit where the brightness adjustment is performed by using the PWM dimming technique is acquired.

Or, in a brightness interval of 7 nit to 58 nit where the brightness adjustment is performed by using the PWM dimming technique, according to the duty 60% and the data voltage Gray127Vdata corresponding to 92 nit, and a known brightness node 58 nit, the data voltage Gray127Vdata corresponding to 58 nit is acquired, and the duty 38% is calculated. Then the relevant parameters of the starting node and the end node of the brightness interval of 7 nit to 58 nit where the brightness adjustment is performed by using the DC dimming technique is acquired.

As described above, each brightness interval of the display device, the dimming technique of each brightness interval, and the brightness, duty, and data voltage of the starting node and the end node of each brightness interval may be acquired. These parameters are stored in the display device, and are used as known parameters to adjust the brightness of the display device after leaving the factory.

In an embodiment, the step of performing the adjustment by using a segmented pulse width modulation dimming technique and power modulation dimming technique includes: acquiring a target brightness value and looking for a target brightness interval to which the target brightness value belongs and a target dimming technique of the target brightness value; if the target dimming technique is the pulse width modulation dimming technique, defining a data voltage corresponding to a starting brightness node of the target brightness interval as a target data voltage corresponding to the target brightness value Lm; selecting a target duty Dm corresponding to the target brightness value according to a formula Dq/Dm=Lq/Lm; and performing a brightness adjustment to the target brightness value according to the target data voltage and the target duty.

In the embodiment, each brightness interval of the display device, the dimming technique of each brightness interval, and the brightness, duty, and data voltage of the starting node and the end node of each brightness interval are all known parameters. Referring to FIG. 6, taking the target brightness value 80 nit as an example, it is determined that the target brightness interval of the target brightness is 58 nit to 92 nit, and the target dimming technique is PWM dimming technique, so the data voltage of 80 nit is maintained as Gray127Vdata; according to the formula $38\%/D_{80}=58/80$, or $D_{80}/60\%=80/92$, and the duty of 80 nit is calculated as about 52%, the data voltage of the display device is adjusted to Gray127Vdata, the duty is adjusted to 52%, and the show brightness of the display device is 80 nit.

In an embodiment, the step of performing a segmented brightness adjustment by using a pulse width modulation dimming technique and a power modulation dimming technique includes: acquiring a target brightness value and looking for a target brightness interval to which the target brightness value belongs and a target dimming technique of the target brightness value; if the target dimming technique is the power modulation dimming technique, defining a duty corresponding to an ending brightness node of the target brightness interval as a target duty corresponding to the target brightness value Lm; calculating a grayscale corresponding to the target brightness value and the target duty of the target brightness value; and searching for a data voltage corresponding to the grayscale according to the gamma curve, and defining the data voltage as a target data voltage at the target brightness value.

In the embodiment, each brightness interval of the display device, the dimming technique of each brightness interval, and the brightness, duty, and data voltage of the starting node and the end node of each brightness interval are all known parameters. Referring to FIG. 6, taking the target brightness value 100 nit as an example, it is determined that the target brightness interval of the target brightness is 92 nit to 430 nit, and the target dimming technique is DC dimming technique, so the duty of 100 nit is maintained as 60%; according to the formula grayscale~brightness (1), the data voltage of 100 nit is calculated as about Gray131Vdata, the data voltage of the display device is adjusted to Gray131Vdata, the duty is adjusted to 60%, and the show brightness of the display device is 100 nit.

As mentioned above, referring to FIG. 6, the duty of 51=0 is set to 10%, that is, duty of all nodes of 51 is greater than or equal to 10%. Here, DC and PWM four-stage dimming techniques are adopted.

In the first stage, 51=0 to a, and the PWM dimming is used. At this time, the Vdata voltage remains the same as Vdata when 51=0, so that the brightness of the display device panel changes by duty change.

In the second stage, 51=a to b, and the DC dimming is used. At this time, the duty remains the same as duty when 51=a, so that the brightness of the display device panel changes by Vdata change.

In the third stage, 51=b to c, and the PWM dimming is used. At this time, the Vdata voltage remains the same as Vdata when 51=b, so that the brightness of the panel changes by duty change.

In the fourth stage, 51=c to FFF, and the DC dimming is used. At this time, the duty remains the same as duty when 51=c, so that the brightness of the panel changes by Vdata change.

It may be understood that the grayscale of the 51 adjustment method may be 8 bit (0-FF), 10 bit (0-3 FF), or 12 bit (0-FFF). The 51 curve may be linear or curved. In the above mentioned dimming technique, dividing into 4 segments are merely examples. The segments may be increased or decreased according to actual needs. At the same time, the dimming technique of each segment may be freely set to PWM or DC.

In an embodiment, the step of performing the brightness adjustment by using a segmented pulse width modulation dimming technique and power modulation dimming technique in S40 includes: setting a first brightness node, where the target initial brightness is smaller than the first brightness node, and the first brightness node is smaller than the maximum brightness; and perform a brightness adjustment in a low brightness interval from the target initial brightness to the first brightness node by using the pulse width modulation dimming technique; and perform a brightness adjustment in a high brightness interval from the first brightness node to the maximum brightness by using the power modulation dimming technique. The difference between the embodiment and FIG. 5 is that the brightness interval of the target initial brightness and the maximum brightness is divided into two intervals by the first brightness node. The first brightness node is greater than the target initial brightness and less than the maximum brightness, where the low brightness interval uses PWM dimming, and the high brightness interval uses DC dimming. The target initial brightness and the corresponding duty and data voltage of the target initial brightness, the maximum brightness and the corresponding maximum duty and maximum data voltage of the maximum brightness, and the brightness value of the first brightness node are known. Then according to the low brightness interval and the PWM dimming technique the duty and data voltage of the first brightness node may be calculated, or according to the high brightness interval and the DC dimming technique, the duty and data voltage of the first brightness node may be calculated. The calculation process of the duty and the data voltage of the first brightness node is similar to the corresponding embodiment in FIG. 6, and details are not described herein again.

Figure 7:
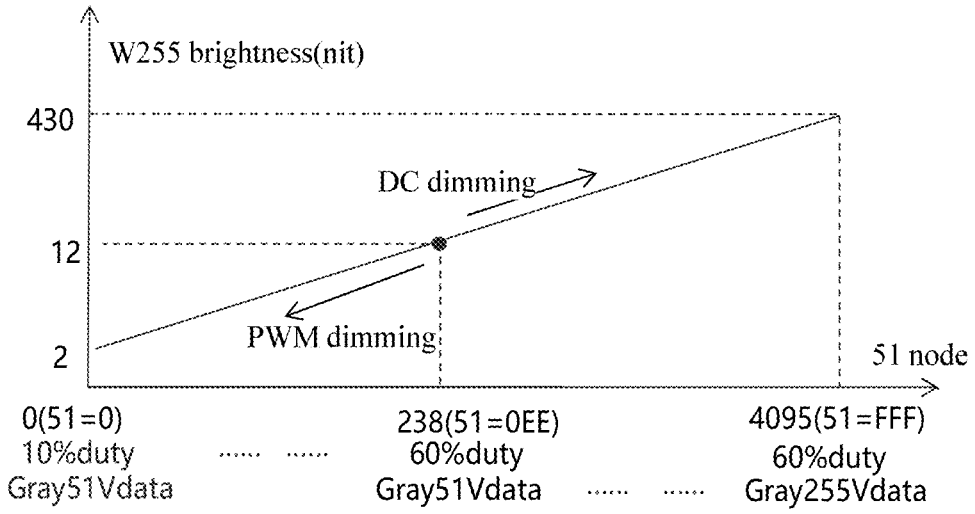
FIG. 7 is shows the relationship between the brightness interval and the dimming amount of the display device according to an embodiment of the present disclosure.

Referring to FIG. 7, the first brightness node may be 12 nit, and it is known that the data voltage of the starting brightness node of the low brightness interval 2 nit to 12 nit is Gray51Vdata. The low brightness interval uses the PWM dimming technique and it is determined that the data voltage of the first brightness node is Gray51Vdata. It is known that the duty of the ending brightness node of the high brightness interval 12 nit to 430 nit is 60%, the high brightness interval uses the DC dimming technique, and it is determined that the duty of the first brightness node is 60%.

Of course, it is also possible to directly calculate the duty of the first brightness node according to the parameters of the starting brightness node of the low brightness interval 2 nit to 12 nit and the duty-brightness formula; or it is also possible to directly calculate the data voltage of the first brightness node according to the parameters of the ending brightness node of the high brightness interval 12 nit to 430 nit, the grayscale-brightness formula and the gamma curve.

In the embodiment, each brightness interval of the display device, the dimming technique of each brightness interval, and the brightness, duty, and data voltage of the starting node and the end node of each brightness interval are all known parameters. If the target brightness value is known, the target duty and target data voltage corresponding to the target brightness value may be calculated, and the data voltage of the display device is adjusted to the target data voltage and the duty is adjusted to the target duty, the display device is enabled to display as the target brightness value.

In the embodiment, the duty without color shift is selected and is set to the lowest duty when the brightness is adjusted, that is, the initial duty, so as to limit the minimum value of the product duty to avoid the color shift. Both the initial duty and the target initial brightness are not 0, which improves the low brightness and color shift at a high frequency during brightness adjustment and optimizes the image display effect of the display device.

Figure 8:
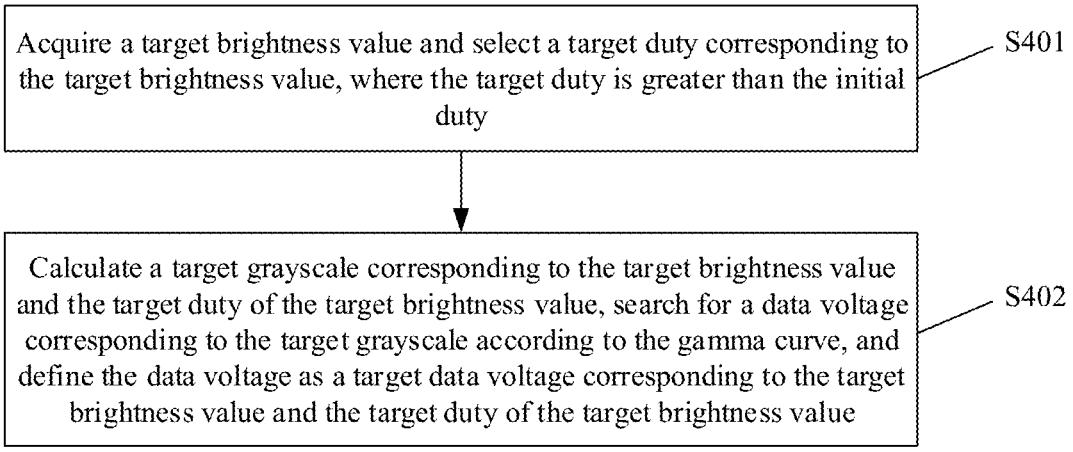
FIG. 8 is a schematic the flow chart of the method at step S40 shown in FIG. 1.

Exemplarily, the operation of performing the brightness adjustment using the mixed pulse width modulation dimming technique and the power modulation dimming technique of S40 as shown in FIG. 8 includes the following steps.

In S401, a target brightness value is acquired and a target duty corresponding to the target brightness value is selected, where the target duty is greater than the initial duty.

In S402, a target grayscale corresponding to the target brightness value and the target duty of the target brightness value is calculated, a data voltage corresponding to the target grayscale is searched for according to the gamma curve, and the data voltage is defined as a target data voltage corresponding to the target brightness value and the target duty of the target brightness value.

Or the step of the performing a mixed brightness adjustment by using the pulse width modulation dimming technique and the power modulation dimming technique includes: acquiring a target brightness value and selecting a target data voltage corresponding to the target brightness value, wherein the target data voltage is greater than the initial data voltage; and searching for a target grayscale corresponding to the target data voltage according to the gamma curve, calculating a duty corresponding to the target brightness value and the target data voltage of the target brightness value, and defining the duty as a target duty corresponding to the target brightness value and the target data voltage of the target brightness value.

In the embodiment, the target initial brightness and the maximum brightness, and the initial duty and the maximum duty are known, so the adjustable duties are all greater the initial duty, which improves the color shift phenomenon. In a brightness interval from the target initial brightness to the maximum brightness, a DC and PWM mixed dimming technique is used, that is, the DC dimming technique and the PWM dimming technique work together in a same time period, so that the brightness of the display device changes.

Figure 9:
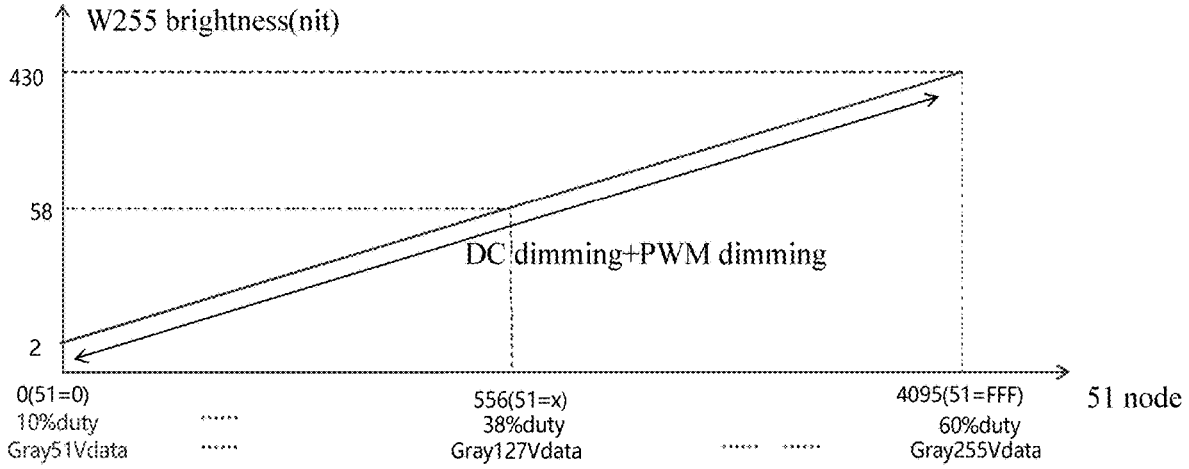
FIG. 9 shows the relationship between the brightness interval and the dimming amount of the display device according to an embodiment of the present disclosure.

Referring to FIG. 9, the target initial brightness and the maximum brightness form a brightness interval, and DC and PWM are mixed for dimming in the brightness interval. In other embodiments, the brightness interval from the target initial brightness to the maximum brightness can also be divided into several sub-intervals according to actual needs, and the ratio of DC and PWM is changed in each sub-interval to adjust the required brightness. When the brightness is adjusted, the duty of the display device may be adjusted firstly, and then the data voltage is adjusted to achieve the target brightness. Or when the brightness is adjusted, the data voltage of the display device may be adjusted firstly, and then the duty is adjusted to achieve the target brightness.

In the embodiment, the duty without color shift is selected and is set to the lowest duty when the brightness is adjusted, that is, the initial duty, so as to limit the minimum value of the product duty to avoid the color shift. Both the initial duty and the target initial brightness are not 0, which improves the low brightness and color shift at a high frequency during brightness adjustment and optimizes the image display effect of the display device.

Figure 10:
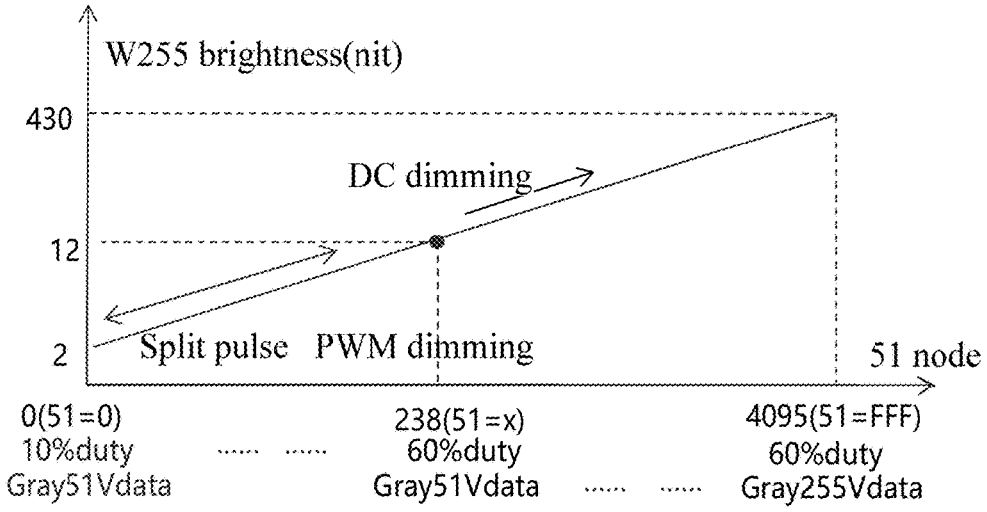
FIG. 10 shows the relationship between the brightness interval and the dimming amount of the display device according to an embodiment of the present disclosure.
Figure 11:
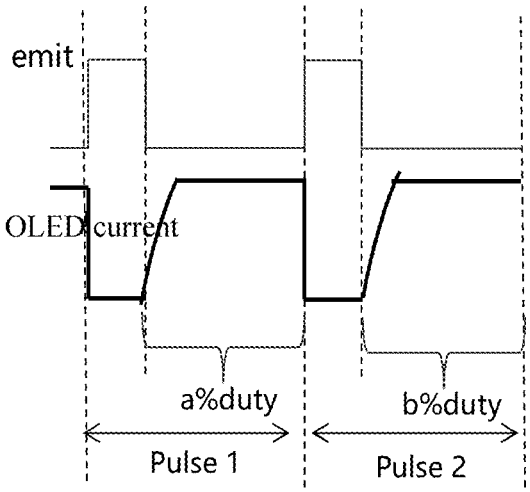
FIG. 11 shows a pulse width adjustment scheme of the display device according to an embodiment of the present disclosure.

Exemplarily, as shown in FIG. 10 and FIG. 11, the step of perform brightness adjustment by using the pulse width modulation dimming technique includes: when the duty of the b-th pulse is less than a preset pulse extreme value, adjusting a light-emitting pulse signal to control a duty of an a-th pulse in the light-emitting pulse signal to remain unchanged and a duty of a b-th pulse in the light-emitting pulse signal to be changed for a brightness adjustment, where $a \neq b$, $a \geq 1$, and $b \geq 1$. In an embodiment, the step of performing the brightness adjustment by using the pulse width modulation dimming technique includes: when the duty of the b-th pulse is equal to the preset pulse extreme value, controlling the duty of the b-th pulse in the light-emitting pulse signal to remain unchanged and the duty of the a-th pulse in the light-emitting pulse signal to be changed for the brightness adjustment.

In the embodiment, in order to make the brightness adjustment more detailed, a split pulse PWM dimming technique may also be adopted. As shown in FIG. 10, the initial duty is 10%. As shown in FIG. 11, a light-emitting signal with two pulses is taken as an example. In a conventional PWM dimming, the duty of pulse1 and pulse2 are changed simultaneously. In order to make the brightness adjustment more detailed, in the embodiment, the duty of pulse1 and pulse2 may be controlled to operate separately. For example, the duty of pulse1 is first kept at a %, and the brightness is changed by adjusting the duty of pulse2 continuously; when the duty of pulse2 reaches a set limit, the duty of pulse1 is started to change. This can make the brightness adjustment more detailed when performing PWM dimming.

It may be understood that the above mentioned light-emitting control signal emit may be two pulses, or may be any pulse of multiple pulses. The above changes of pulse1 and pulse2 may be that: adjusting one after the other, or starting to adjust one when the other is adjusted at a certain stage, and then readjusting the first one at a certain stage. Different combinations of adjustment techniques between pulse1 and pulse2 are all within the constraints of the embodiment.

In the embodiment, the duty without color shift is selected and is set to the lowest duty when the brightness is adjusted, that is, the initial duty, so as to limit the minimum value of the product duty to avoid the color shift. Both the initial duty and the target initial brightness are not 0, which improves the low brightness and color shift at a high frequency during brightness adjustment and optimizes the image display effect of the display device.

An embodiment of the present disclosure also provides an apparatus to control a display device. The apparatus provided in the embodiment is capable of executing the method described in any of the above embodiments. The control apparatus is implemented in software and/or hardware and is configured in applications in display devices.

The control apparatus of the display device in the embodiment includes a parameter setting module, a grayscale calculation module and a brightness adjustment module.

The parameter setting module is configured to select an initial duty and target initial brightness which generate color shift less than or equal to a preset color shift value.

The grayscale calculation module is configured to calculate a corresponding initial grayscale according to the initial duty and the target initial brightness, search for an initial data voltage corresponding to the initial grayscale according to a gamma curve, where the initial data voltage is associated with the initial duty and the target initial brightness.

The brightness adjustment module is configured to perform a brightness adjustment, where the brightness adjustment includes a segmented or a mixed pulse width modulation dimming technique and power modulation dimming technique, where the brightness adjustment is performed in a brightness interval from the target initial brightness to maximum brightness.

In an embodiment, the grayscale calculation module is specifically configured to calculate the initial grayscale corresponding to the initial duty and the target initial brightness according to a formula (1), $(GrayA/255)^k=LA/(Lmax*DA/Dmax)$ (1).

GrayA is a grayscale corresponding to a duty DA and brightness LA, k is a gamma value of the gamma curve, Lmax is the maximum brightness of the display device, and Dmax is a duty corresponding to the maximum brightness Lmax.

In an embodiment, the display device includes a red sub-pixel, a green sub-pixel and a blue sub-pixel.

The parameter setting module includes a light-emitting calculation unit, a parameter calculation unit, and a duty test unit.

The light-emitting calculation unit is configured to control the red sub-pixel, the green sub-pixel and the blue sub-pixel to emit light, collect charging duration of the red sub-pixel, charging duration of the green sub-pixel, and charging duration of the blue sub-pixel separately, select a maximum charging duration as target charging duration T1, and then collect sub-pixel light-emitting duration T2.

The parameter calculation unit is configured to calculate a preset duty D0 according to a formula T1/T2=D0/Dmax.

The duty test unit is configured to increase the preset duty step by step, measure color coordinates and select an inflection point at which white color coordinates are not subjected to color shift, and define a duty corresponding to the inflection point as the initial duty.

The parameter setting module includes a color shift test unit and a duty selection unit.

The color shift test unit is configured to reduce from a duty corresponding to the maximum brightness step by step to a first duty according to a first step value, and measure color coordinates and determine whether white color coordinates are subjected to the color shift.

The duty selection unit is configured to: in response to determining that the color shift does not occur, reduce from the first duty step by step according to a second step value, measure the color coordinates and select an inflection point at which the white color coordinates are not subjected to the color shift, and define a duty corresponding to the inflection point as the initial duty; where the first step value is greater than the second step value.

The brightness adjustment module includes a brightness setting unit and a brightness adjustment unit.

The brightness setting unit is configured to set a low brightness node and a high brightness node, where the target initial brightness is smaller than the low brightness node, the low brightness node is smaller than the high brightness node, and the high brightness node is smaller than the maximum brightness.

The brightness adjustment unit is configured to perform a brightness adjustment in a low brightness interval from the target initial brightness to the low brightness node by using the pulse width modulation dimming technique; perform the brightness adjustment in a high brightness interval from the high brightness node to the maximum brightness by using the power modulation dimming technique; and perform the brightness adjustment by alternating the power modulation dimming technique and the pulse width modulation dimming technique in cyclic segmented intermediate brightness intervals divided between the low brightness node and the high brightness node.

In the embodiment of the present disclosure, the preset color shift value is provided, the initial duty and the target initial brightness which generate a color shift is less than or equal to the preset color shift value is selected, the duty adjustment interval is from the initial duty to the maximum duty, and the brightness adjustment interval is the target initial brightness to the maximum brightness. Obviously, the minimum duty of the display device is the initial duty, and the minimum brightness is the target initial brightness. Under the initial duty and target initial brightness, the color shift of the display device is less than or equal to the preset color shift value, and the severe color shift at low brightness when adjusting the brightness of the display device is improved. In addition, in the embodiment of the present disclosure, in the brightness interval from the target initial brightness to the maximum brightness, the pulse width modulation dimming technique and the power modulation dimming technique are used to perform segmented brightness adjustment, or the pulse width modulation dimming technique and the power modulation dimming technique are used for mixed brightness adjustment. The brightness adjustment methods are simple and applicable to all display devices including high frequency display devices. The duty and brightness of an adjusted point are greater than or equal to the initial duty and the target initial brightness. Therefore, the color shift of the adjusted point is less than or equal to the preset color shift value, the severe color shift at low brightness when adjusting the brightness of the display device is effectively alleviated.

An embodiment of the present disclosure provides a display device including the control apparatus as described in above any embodiment. In an embodiment, the display device is an organic light-emitting display device.

The display device of the embodiment is adjusted using the brightness adjustment method described above, and the duty without color shift is selected and is set to the initial duty when the brightness is adjusted, so as to limit the minimum value of the product duty to avoid the color shift. Both the initial duty and the target initial brightness are not 0, which improves the low brightness and color shift at a high frequency during brightness adjustment and optimizes the image display effect of the display device. In the embodiment, the brightness adjustment method is simple and applicable to all display devices including high frequencies. No additional adjustment and insertion of multiple sets of gamma curves is required, which greatly saves generation time and does not require additional storage space to store the inserted gamma curve, solves the long time consumption and low productivity of low brightness processing methods of existing products, and improves the display quality and user experience of display devices.

It is to be noted that the above are merely preferred embodiments of the present disclosure and the technical principles used therein. It will be understood by those skilled in the art that the present disclosure is not limited to the specific embodiments described herein. Those skilled in the art can make various apparent modifications, adaptations, combinations and substitutions without departing from the scope of the present disclosure. Therefore, while the present disclosure has been described in detail through the above-mentioned embodiments, the present disclosure is not limited to the above-mentioned embodiments and may include more other equivalent embodiments without departing from the concept of the present disclosure. The scope of the present disclosure is determined by the scope of the appended claims.

What is claimed is:

1. A method to control a display device, comprising:

providing a preset color shift value;

selecting an initial duty and a target initial brightness which generate a color shift less than or equal to the preset color shift value;

calculating a corresponding initial grayscale according to the initial duty and the target initial brightness;

searching for an initial data voltage corresponding to the initial grayscale according to a gamma curve, wherein the initial data voltage is associated with the initial duty and the target initial brightness; and performing a brightness adjustment, wherein the brightness adjustment comprises either a segmented or a mixed pulse width modulation dimming technique and a power modulation dimming technique, wherein the brightness adjustment is performed in a brightness interval from the target initial brightness to maximum brightness;

wherein the calculating a corresponding initial grayscale according to the initial duty and the target initial brightness comprises:

calculating the initial grayscale corresponding to the initial duty and the target initial brightness according to a formula (1):

$$(\mathrm{Gray}A/255)^k = LA/(L\mathrm{max} * DA/D\mathrm{max}) \quad (1)$$

wherein GrayA is a grayscale corresponding to a duty DA and brightness LA, k is a gamma value of the gamma curve, Lmax is the maximum brightness of the display device, and Dmax is a duty corresponding to the maximum brightness Lmax.

2. The method to control the display device of claim 1, wherein the display device comprises a red sub-pixel, a green sub-pixel, and a blue sub-pixel;

wherein the selecting an initial duty and a target initial brightness comprises:

controlling the red sub-pixel, the green sub-pixel, and the blue sub-pixel to emit light, collecting charging duration of the red sub-pixel, charging duration of the green sub-pixel, and charging duration of the blue sub-pixel separately, selecting a maximum charging duration among the charging durations of the red sub-pixel, the charging duration of the green sub-pixel and the charging duration of the blue sub-pixel as target charging duration T1, and then collecting sub-pixel light-emitting duration T2;

calculating a preset duty D0 according to a formula T1/T2=D0/Dmax; and increasing the preset duty step by step, measuring color coordinates and looking for an inflection point at which white color coordinates are not subjected to color shift, and defining a duty corresponding to the inflection point as the initial duty.

3. The method to control the display device of claim 1, wherein the selecting the initial duty and target initial brightness which generate color shift less than or equal to a preset color shift value comprises:

reducing from a duty corresponding to the maximum brightness step by step to a first duty according to a first step value, and measuring color coordinates and determining whether white color coordinates are subjected to color shift; and in response to determining that the white color coordinates are not subjected to the color shift, reducing from the first duty step by step according to a second step value, measuring the color coordinates and selecting an inflection point at which the white color coordinates are not subjected to the color shift, and defining a duty corresponding to the inflection point as the initial duty;

wherein the first step value is greater than the second step value.

4. The method to control the display device of claim 1, wherein the performing a segmented brightness adjustment by using the pulse width modulation dimming technique and the power modulation dimming technique comprises:

setting a low brightness node and a high brightness node, wherein the target initial brightness is smaller than the low brightness node, the low brightness node is smaller than the high brightness node, and the high brightness node is smaller than the maximum brightness; and performing the brightness adjustment in a low brightness interval from the target initial brightness to the low brightness node by using the pulse width modulation dimming technique;

performing the brightness adjustment in a high brightness interval from the high brightness node to the maximum brightness by using the power modulation dimming technique; and performing the brightness adjustment by alternating the power modulation dimming technique and the pulse width modulation dimming technique in cyclic segmented brightness intervals between the low brightness node and the high brightness node;

wherein the brightness adjustment comprising segmented pulse width modulation dimming technique and power modulation dimming technique includes:

setting a first brightness node, wherein the target initial brightness is smaller than the first brightness node, and the first brightness node is smaller than the maximum brightness; and performing a brightness adjustment in a low brightness interval from the target initial brightness to the first brightness node by using the pulse width modulation dimming technique; and performing a brightness adjustment in a high brightness interval from the first brightness node to the maximum brightness by using the power modulation dimming technique.

5. The method to control the display device of claim 4, wherein performing the brightness adjustment in a brightness interval by using the pulse width modulation dimming technique comprises:

acquiring a first data voltage corresponding to a starting brightness node Lq of the brightness interval, and acquiring a second data voltage corresponding to an ending brightness node Lz of the brightness interval; and selecting a duty Dz corresponding to the ending brightness node according to a formula Dq/Dz=Lq/Lz, wherein Dq is a duty corresponding to the starting brightness node.

6. The method to control the display device of claim 4, wherein performing the brightness adjustment in a brightness interval by using the power modulation dimming technique comprises:

acquiring a duty corresponding to an ending brightness node Lz of the brightness interval, and defining the duty as a duty corresponding to a starting brightness node Lq of the brightness interval; calculating a grayscale corresponding to the starting brightness node and the duty of the starting brightness node; and searching for a data voltage corresponding to the gray scale according to the gamma curve, and defining the data voltage as a data voltage corresponding to the starting brightness node Lq.

7. The method to control the display device of claim 4, wherein the performing the brightness adjustment comprising the segmented pulse width modulation dimming technique and power modulation dimming technique comprises:

acquiring a target brightness value, looking for a target brightness interval to which the target brightness value belongs and a target dimming technique of the target brightness value;

in response to determining that the target dimming technique is the pulse width modulation dimming technique, defining a data voltage corresponding to a starting brightness node of the target brightness interval as a target data voltage corresponding to the target brightness value Lm;

defining a target duty Dm corresponding to the target brightness value according to a formula Dq/Dm=Lq/Lm; and performing the brightness adjustment to the target brightness value according to the target data voltage and the target duty to reach the target brightness value.

8. The method to control the display device of claim 4, wherein the performing the brightness adjustment by using the segmented pulse width modulation dimming technique and power modulation dimming technique comprises:

acquiring a target brightness value and looking for a target brightness interval to which the target brightness value belongs and a target dimming technique of the target brightness value;

in response to determining that the target dimming technique is the power modulation dimming technique, defining a duty corresponding to an ending brightness node of the target brightness interval as a target duty at the target brightness value Lm;

calculating a grayscale corresponding to the target brightness value and the target duty of the target brightness value; and searching for a data voltage corresponding to the grayscale according to the gamma curve, and defining the data voltage as a target data voltage at the target brightness value.

9. The method to control the display device of claim 1, wherein the performing the brightness adjustment comprising the mixed pulse width modulation dimming technique and the power modulation dimming technique comprises:

acquiring a target brightness value and selecting a target duty corresponding to the target brightness value, wherein the target duty is greater than the initial duty; and calculating a target grayscale corresponding to the target brightness value and the target duty of the target brightness value, searching for a data voltage corresponding to the target grayscale according to the gamma curve, and defining the data voltage as a target data voltage corresponding to the target brightness value and the target duty of the target brightness value.

10. The method to control the display device of claim 1, wherein the performing a mixed brightness adjustment by using the pulse width modulation dimming technique and the power modulation dimming technique comprises:

acquiring a target brightness value and selecting a target data voltage corresponding to the target brightness value, wherein the target data voltage is greater than the initial data voltage; and searching for a target grayscale corresponding to the target data voltage according to the gamma curve, calculating a duty at the target brightness value and the target data voltage of the target brightness value, and defining the duty as a target duty corresponding to the target brightness value and the target data voltage of the target brightness value.

11. The method to control the display device claim 1, wherein performing the brightness adjustment by using the pulse width modulation dimming technique comprises:

in a case where a duty of a b-th pulse in the light-emitting pulse signal is less than a preset pulse extreme value, adjusting the light-emitting pulse signal to control a duty of an a-th pulse in the light-emitting pulse signal to remain unchanged and the duty of the b-th pulse in the light-emitting pulse signal to be changed for the brightness adjustment, wherein $a \neq b$, $a \geq 1$, and $b \geq 1$.

12. The method to control the display device of claim 11, wherein performing the brightness adjustment by using the pulse width modulation dimming technique comprises:

in a case where the duty of the b-th pulse is equal to the preset pulse extreme value, controlling the duty of the b-th pulse in the light-emitting pulse signal to remain unchanged and the duty of the a-th pulse in the light-emitting pulse signal to be changed for the brightness adjustment.

13. An apparatus of controlling a display, comprising:

a parameter setting module, which is configured to select an initial duty and a target initial brightness which generate a color shift less than or equal to a preset color shift value;

a grayscale calculation module, which is configured to calculate an initial grayscale according to the initial duty and the target initial brightness, search for an initial data voltage of the initial grayscale according to a gamma curve, wherein the initial data voltage is associated with the initial duty and the target initial brightness; and a brightness adjustment module, which is configured to perform a brightness adjustment, wherein the brightness adjustment comprises either a segmented or a mixed pulse width modulation dimming technique and power modulation dimming technique, wherein the brightness adjustment in a brightness interval from the target initial brightness to maximum brightness;

wherein the grayscale calculation module is specifically configured to calculate the initial grayscale corresponding to the initial duty and the target initial brightness according to a formula (1):

$$(\text{Gray}A/255)^k = LA/(L\text{max}*DA/D\text{max}) \quad (1);$$

wherein GrayA is a grayscale corresponding to a duty DA and brightness LA, k is a gamma value of the gamma curve, Lmax is the maximum brightness of the display device, and Dmax is a duty corresponding to the maximum brightness Lmax.

14. The apparatus of controlling of the display of claim 13, wherein the display device comprises a red sub-pixel, a green sub-pixel, and a blue sub-pixel; and wherein the parameter setting module comprises:

a light-emitting calculation unit, which is configured to control the red sub-pixel, the green sub-pixel and the blue sub-pixel to emit light, collect charging duration of the red sub-pixel, charging duration of the green sub-pixel, and charging duration of the blue sub-pixel separately, select a maximum charging duration among the charging durations of the red sub-pixel, the charging duration of the green sub-pixel and the charging duration of the blue sub-pixel as target charging duration T1, and then collect sub-pixel light-emitting duration T2;

a parameter calculation unit, which is configured to calculate a preset duty D0 according to a formula T1/T2=D0/Dmax; and a duty test unit, which is configured to increase the preset duty step by step, measure color coordinates and select an inflection point at which coordinates of white light are not subjected to color shift, and define a duty corresponding to the inflection point as the initial duty, wherein the white light is a resultant of a red light, a green light, and a blue light from the red, the green, and the blue sub-pixels.

15. The apparatus of controlling of the display of claim 13, wherein the parameter setting module comprises:

a color shift test unit, which is configured to reduce from a duty corresponding to the maximum brightness step by step to a first duty according to a first step value, and measure color coordinates and determine whether white color coordinates are subjected to color shift; and a duty selection unit, which is configured to, in response to determining that the white color coordinates are not subjected to the color shift, reduce from the first duty step by step according to a second step value, measure the color coordinates and select an inflection point at which the white color coordinates are not subjected to the color shift, and define a duty corresponding to the inflection point as the initial duty; wherein the first step value is greater than the second step value.

16. The apparatus of controlling of the display of claim 13, wherein the brightness adjustment module comprises:

a brightness setting unit, which is configured to set a low brightness node and a high brightness node, wherein the target initial brightness is smaller than the low brightness node, the low brightness node is smaller than the high brightness node, and the high brightness node is smaller than the maximum brightness; and a brightness adjustment unit, which is configured to perform the brightness adjustment in a low brightness interval from the target initial brightness to the low brightness node by using the pulse width modulation dimming technique; perform the brightness adjustment in a high brightness interval from the high brightness node to the maximum brightness by using the power modulation dimming technique; and perform the brightness adjustment by alternating the power modulation dimming technique and the pulse width modulation dimming technique in cyclic segmented brightness intervals between the low brightness node and the high brightness node.

17. A display device, comprising a control device, wherein the display device comprises:

a parameter setting module, which is configured to select an initial duty and a target initial brightness which generate a color shift less than or equal to a preset color shift value;

a grayscale calculation module, which is configured to calculate a corresponding initial grayscale according to the initial duty and the target initial brightness, search for an initial data voltage corresponding to the initial grayscale according to a gamma curve, wherein the initial data voltage is associated with the initial duty and the target initial brightness; and a brightness adjustment module, which is configured to perform a brightness adjustment, wherein the brightness adjustment comprises either a segmented or a mixed pulse width modulation dimming technique and power modulation dimming technique, in a brightness interval from the target initial brightness to maximum brightness;

wherein the grayscale calculation module is specifically configured to calculate the initial grayscale corresponding to the initial duty and the target initial brightness according to a formula (1):

$$(\text{Gray}A/255)^k = LA/(L\text{max}*DA/D\text{max}) \quad (1);$$

wherein GrayA is a grayscale corresponding to a duty DA and brightness LA, k is a gamma value of the gamma curve, Lmax is the maximum brightness of the display device, and Dmax is a duty corresponding to the maximum brightness Lmax.

* * * * *